US008961864B2

(12) United States Patent
Lemay et al.

(10) Patent No.: US 8,961,864 B2
(45) Date of Patent: Feb. 24, 2015

(54) METHOD AND APPARATUS FOR REMOVING COOLANT LIQUID FROM MOVING METAL STRIP

(75) Inventors: Rejean Lemay, Kingston (CA); Andrew Hobbis, Kingston (CA); Heinz Becker, Kingston (CA); David Gaensbauer, Atlanta, GA (US)

(73) Assignee: Novelis Inc., Atlanta, GA (US)

( * ) Notice: Subject to any disclaimer, the term of this patent is extended or adjusted under 35 U.S.C. 154(b) by 310 days.

(21) Appl. No.: 13/421,266

(22) Filed: Mar. 15, 2012

(65) Prior Publication Data

US 2012/0235331 A1 Sep. 20, 2012

Related U.S. Application Data

(60) Provisional application No. 61/465,393, filed on Mar. 18, 2011.

(51) Int. Cl.

| | |
|---|---|
| ***C21D 9/52*** | (2006.01) |
| ***C21D 1/667*** | (2006.01) |
| ***B21B 45/02*** | (2006.01) |

(52) U.S. Cl.

CPC ..... *C21D 1/667* (2013.01); *B21B 45/0218* (2013.01); *B21B 45/0281* (2013.01); *C21D 9/52* (2013.01)

USPC ..... 266/46; 266/113

(58) Field of Classification Search

CPC ..... B21B 45/0218; C21D 1/667; C21D 9/52

USPC ..... 266/44, 46, 113

See application file for complete search history.

(56) References Cited

U.S. PATENT DOCUMENTS

| | | | | |
|---|---|---|---|---|
| 3,367,804 | A | 2/1968 | Teplitz | |
| 4,400,961 | A | 8/1983 | Schaming | |
| 5,440,779 | A | 8/1995 | Collinson | |
| 5,701,775 | A | 12/1997 | Sivilotti et al. | |
| 7,582,251 | B2 * | 9/2009 | Ebner | 266/113 |
| 2012/0235331 | A1 * | 9/2012 | Lemay et al. | 266/44 |

FOREIGN PATENT DOCUMENTS

| | | |
|---|---|---|
| GB | 1 016 025 A | 1/1966 |
| JP | 6-304613 A | 11/1994 |

OTHER PUBLICATIONS

Canadian Intellectual Property Office, International Search Report, May 16, 2012, PCT/CA2012/050148 (Novelis Inc. et al.).

* cited by examiner

*Primary Examiner* — Scott Kastler

(74) *Attorney, Agent, or Firm* — Kilpatrick Townsend & Stockton LLP

(57) ABSTRACT

Exemplary embodiments of the invention include a method and apparatus for cooling a metal strip that is being advanced in a generally horizontal fashion. The method involves delivering a coolant liquid onto a lower surface of the strip from below across the entire width of the strip, preventing the coolant liquid from contacting the upper surface of the strip, and optionally subsequently removing the coolant liquid from the lower surface. The coolant liquid is prevented from contacting the upper surface by forming a gas-directing channel immediately above the upper surface of the strip adjacent to one or preferably both lateral edges of the strip and forcing a gas through the channel in a direction generally away from a center of the strip towards the one or both lateral edges to deflect coolant liquid away from the upper surface of the strip. The apparatus provides means for carrying out these steps.

33 Claims, 6 Drawing Sheets

METHOD AND APPARATUS FOR REMOVING COOLANT LIQUID FROM MOVING METAL STRIP

CROSS-REFERENCE TO RELATED APPLICATIONS

This application claims the priority right of prior copending provisional patent application Ser. No. 61/465,393 filed on Mar. 18, 2011 by applicants named herein. The entire disclosure of application Ser. No. 61/465,393 is specifically incorporated herein by this reference.

BACKGROUND OF THE INVENTION (1) Field of the Invention

This invention relates to methods and apparatus for applying liquid coolant to, and subsequently removing the coolant from, metal strip advancing in a continuous line. Preferably, although not exclusively, the invention is directed to the cooling of metal strip in single-stand and multi-stand cold rolling mills. Still more particularly, the invention is concerned with methods and apparatus for liquid cooling of metal strip, such as aluminum strip.

(2) Description of the Related Art

In the processing of metal sheet such as aluminum strip (the term "aluminum" being used herein to refer to aluminum-based alloys as well as pure aluminum metal), such metal sheet is often cooled by application of a coolant liquid (e.g. water) followed shortly thereafter by the removal of the coolant liquid before further processing or coiling takes place. For example, coated metal sheet may be cooled following the application and heat-curing of a layer of coating lacquer, or hot-rolled aluminum strip may be cooled before it is coiled at the end of a hot roll line or in a separate coil-to-coil operation. In such cases, the coolant liquid is often applied to just one side of the metal sheet and steps may be taken to avoid contact of the coolant liquid with the other side of the sheet if such contact would cause damage (e.g. to a coating layer) or undesirable marking or staining.

A further important situation where such cooling is carried out is during the reduction in thickness of metal (especially aluminum) strip by cold working in one or a tandem succession of roll stands each typically including upper and lower work rolls (between which the strip passes) and upper and lower backup rolls respectively above and below (and in contact with) the upper and lower work rolls. The strip to be reduced in thickness is paid out from a coil at the upstream end of the cold rolling line, and after passage through the roll stand or stands, is rewound into a coil at the downstream end of the line, the cold-rolling operation being essentially continuous. Unavoidably, the cold working of the strip as it passes through the nip of each roll stand is accompanied by some elevation of strip temperature. In a single-stand mill, this temperature rise is usually not troublesome provided the strip enters the mill near room temperature. In a multi-stand tandem mill, however, the increases in strip temperature at the several roll stands are cumulative, with the result that the intermediate and/or exit temperature of the strip from the mill may exceed acceptable limits, even with entry at room temperature. For example, computer model analysis of a three-stand mill indicates that the strip exit temperature can approach a value as high as 300° C., depending primarily on the particular alloy being rolled, the extent of the reductions to which the strip is subjected in the mill, and the rolling conditions. On the other hand, considerations related to process reliability, such as the avoidance of strip breaks, and metallurgical and mechanical considerations related to product performance, require that the exit or coiling temperature of cold-rolled aluminum strip be kept usually between 100° and 180° C., depending on the product, with a typical limiting value being around 150° C. Moreover, in the case of some products, it would be highly advantageous to control the coiling temperature of cold-rolled strip within some predetermined range for maximum efficiency and benefit in subsequent process steps.

At the same time, as the cold-rolled strip is cooled, it is important that the cooling operation not adversely affect other aspects of product quality. For example, while water is a preferred liquid coolant from the standpoint of cost and effectiveness, the presence of water may impair the performance of rolling lubricant at the roll stands and, if the strip is aluminum or other water-stainable metal, residual water in the rewound coil may cause unacceptable surface staining.

U.S. Pat. No. 5,701,775 which issued to Sivilotti et al. on Dec. 30, 1997 addresses these issues and provides a process and apparatus of cooling horizontally-advancing metal strips by applying upward jets of liquid coolant only to the lower surface of the strip and then removing the coolant from the lower surface by directing liquid knives against the lower surface of the strip. Recognizing that any given cold-rolling mill is usually employed at different times to roll metal strips of various different widths, arrays of laterally-movable overlapping metal shutters were provided along and slightly below each side of the strip path for deflecting upward jets of coolant positioned beyond the lateral edges of a particular strip undergoing a rolling operation. The shutters thereby prevent the cooling jets from splashing onto the upper surface of the strip and causing problems as indicated above.

While this patented solution is quite effective, experience showed that some coolant could still bypass the shutters and contact the upper surface of the strip. To prevent this, it has become usual to provide vertical brushes mounted on the upper side of the movable shutters closest to the strip. As the strip advances, the brushes push up against the underside of the strip at the edges and are slightly, and sometimes severely, splayed out under compression, thereby closing any gap between the shutters and the edges of the strip to prevent penetration of liquid. This solution also has its problems, however, in that it is not always possible to position the brushes exactly at the edges of the strip, especially if the width of the strip varies somewhat at different longitudinal positions. This can allow liquid coolant to extend onto the upper surface of the strip and/or can cause uneven cooling at the edge of the strip, thereby resulting in edge distortion (e.g. a wrinkling or buckling of the strip at the edges). There is therefore a need for further improvements of the method and apparatus.

BRIEF SUMMARY OF THE EXEMPLARY EMBODIMENTS

An exemplary embodiment of the invention provides a method of cooling a metal strip. The method involves continuously advancing a metal strip, having lateral edges, generally horizontally in a direction of strip advance, delivering a coolant liquid onto a lower surface of metal strip from below across the entire width of the strip, preventing the coolant liquid from contacting the upper surface of the metal strip, and optionally subsequently removing said coolant liquid from said lower surface of the strip. The coolant liquid is prevented from contacting the upper surface of the metal strip by forming a gas-directing channel immediately above the upper surface of the metal strip adjacent to at least one of the lateral edges thereof and forcing a gas through the channel in a direction generally away from a center of the strip towards the at least one lateral edge to deflect coolant liquid away from the upper surface of the strip. In this way, coolant liquid emerging from below the strip at the lateral edge or edges thereof is directed away from the upper surface of the strip regardless of any slight variations that may occur in the width of the strip (causing slight undulations in the otherwise linear lateral strip edges) as the strip advances. A gas-directing channel is one that constrains or confines gas to move in a generally horizontal plane towards a lateral edge of the strip and helps to prevent dispersion (especially upward dispersion) of the gas so that the gas streams along the upper surface of the strip and directly across the lateral edge of the strip. Gas-directing channels are preferably formed above both lateral edges of the advancing strip to ensure that coolant liquid is preventing from contacting the upper surface from both sides, but in some circumstances it may be preferred to provide a gas-directing only on one side of the strip.

The gas-directing channel is preferably formed by positioning at least one stationary cover plate above and upwardly spaced from the upper surface of the strip adjacent to the at least one lateral edge, the gas-directing channel being defined between the upper surface and the cover plate. The cover plate is preferably positioned to extend laterally of the strip at least up to the at least one lateral edge of the strip, and more preferably beyond the lateral edge, most preferably covering all positions where there is upward delivery of coolant liquid beyond the lateral edge of the strip.

The coolant liquid is preferably delivered upwardly from at least one manifold extending transversely below the strip and extending laterally beyond the at least one lateral edge thereof (to ensure that all of the lower surface of the strip is cooled regardless of any variations on width of the strip as it passes the manifold(s)).

At least some of the coolant liquid delivered from ends of the manifold(s) extending outwardly beyond the lateral edge(s) of the strip may be deflected downwardly by at least one stationary shutter provided alongside the strip. This is preferably a flat plate normally positioned at about the same vertical height as the strip itself that sits above the upward jet of coolant liquid and deflects it back downwardly. However, the shutter cannot normally be positioned too close to the strip because there must be a gap wide enough to allow for variations in the width of the strip, and coolant liquid may pass upwardly through the gap. However, the any such liquid is deflected away from the strip by the gas passing through the gas-directing passage. Of course, such shutters may be dispensed with if the flow of gas in the channel is sufficient by itself to deflect all coolant liquid beyond the lateral strip edge(s).

The gas is preferably forced through the gas-directing channel by delivery of the gas under pressure from at least one elongated air knife positioned at an end of the channel positioned inwardly of the strip. Most preferably, the air knife is angled to deliver the gas under pressure into the channel at an angle within a range of 30 to 45° relative to the horizontal upper surface of the strip. The gas may be forced through the channel at an initial pressure in a range, for example, of 50 to 150 pounds per square inch (345 to 1034 kilo Pascals), and at a flow rate in a range, for example, of 40 to 50 cubic feet per minute (18.9 to 23.6 liters per second). Normally, the gas is directed through the channel at right angles to the edge of the lateral edge. However, the gas-directing channel may be elongated in the direction of strip advance so that it has upstream and downstream sides. The gas may then be directed generally at right angles to the lateral edge of the strip in a center of the channel between the upstream and downstream sides, but at slight upstream and downstream angles to the lateral edge of the strip at adjacent to the upstream and downstream sides, respectively, of the channel.

Another exemplary embodiment provides apparatus for cooling an elongated metal strip having lateral edges, as the strip is advanced generally horizontally in a direction of strip advance. The apparatus comprises coolant delivery equipment for directing a coolant liquid upwardly onto a lower surface of the advancing strip across an entire width of the strip between said lateral edges thereof, means for preventing said coolant liquid from contacting an upper surface of the metal strip, and optionally a removal device for subsequently removing the coolant liquid from said lower surface of the strip. The means for preventing the coolant liquid from contacting the upper surface of the metal strip includes at least one cover plate positioned above and spaced upwardly from the upper surface of the metal strip adjacent to at least one lateral edge thereof to create at least one gas-directing channel above the strip, and a gas delivery device positioned at an inward end of said at least one gas-directing channel to deliver gas through the channel generally towards said lateral edges.

In the apparatus, the at least one cover plate preferably extends laterally of the strip at least up to, and preferably beyond, the at least one lateral edge of the strip.

The upward delivery of coolant liquid is preferably provided by one or more (ideally two or more) coolant liquid manifolds each provided with at least one opening positioned to deliver the coolant liquid in an upward direction. The one or more manifolds are normally oriented transversely of the strip and are arranged side-by-side in the direction of strip advance. Preferably, the cover plate or cover plates extend above all of the coolant liquid manifolds in the direction of strip advance so that all upward jets of coolant liquid are affected by the flow of gas in the gas-directing channel. However, in some cases, there is insufficient room to extend the cover plates above all of the manifolds, and in such cases, the direction of the gas within the channel is orientated partially upstream or downstream to deliver gas across the lateral edge(s) at all positions where there is an upward flow of coolant liquid to ensure that all of the liquid is deflected away from the upper surface of the strip. Moreover, if there are relatively large gaps between adjacent manifolds below the strip, the gas flowing in the channel may be orientated to mainly pass across the edge(s) of the strip directly above the manifolds, with little or no gas directed to pass above the gaps between the manifolds.

The apparatus may preferably include one or more stationary shutters adjacent to the lateral edge(s) of the strip positioned to deflect downwardly some of said liquid coolant delivered beyond the lateral edge (or edges) of the strip. Such shutters are generally positioned at approximately the same vertical height as the strip and at a distance from the adjacent lateral edge to form a gap to accommodate variations of width of the strip as the strip advances past the shutter(s). The cover plate is generally at a higher vertical level than the shutter(s), and may extend partially or fully above the shutter(s), and even beyond the far side of the shutter(s).

The device used to deliver gas into the channel(s) is preferably an elongated air knife, preferably oriented to deliver the gas toward the lateral edge of the strip but at an angle in a range of 30 to 45° relative to said upper surface of the strip. The air knife may have a single elongated slot through which said gas passes, or multiple gas outlets provided with direction-adjustable nozzles. Moreover, the air knife may have a central region, an upstream region and a downstream region, wherein the central region is oriented to direct the gas generally at right angles to the lateral edge of the strip, the upstream region is oriented to direct the gas towards the lateral edge at an upstream angle, and the downstream region is oriented to direct the gas towards the lateral edge at a downstream angle.

When the gas is to be directed to each lateral edge of the strip, preferably two cover plates are provide, each one above the strip at each longitudinal side. The inboard edges of the cover plates may be separated by a distance suitable to allow one or more air knives to be positioned to introduce flows of gas into the channels defined by each cover plate. Alternatively, a single cover plate may be employed for both sides of the strip, with air knives being positioned between the strip and the cover plate, or passing through slots provided in the cover plate so that gas can be introduced into the channels on each side of the strip.

The cover plate(s) may be suspended from a support frame or the like positioned above the advancing metal strip and may include pivoted supports that allow the cover plate(s) to be raised and lowered relative to the support frame. The support frame may take the form of a box-like structure extending completely across the advancing strip, cover plate(s), manifolds, shutter(s), etc., itself supported by lateral walls.

The or each cover plate is preferably spaced upwardly from the strip by a distance in a range of 0.5 to 1.5 inches (1.3 to 3.8 cm), more preferably by 1 inch (2.5 cm)±10%. This allows the gas to be confined adjacent to the upper surface of the strip while allowing sufficient gas flow and volume. However, other spacings and dimensions may be suitable in particular circumstances.

A further embodiment of the invention provides apparatus for cold rolling a metal strip having lateral edges, having at least one roll stand for reducing a thickness of said metal strip, and an apparatus for cooling said metal strip immediately downstream of said at least one roll stand. The apparatus for cooling the metal strip comprises an apparatus as defined above.

DETAILED DESCRIPTION OF THE EXEMPLARY EMBODIMENTS

Figure 1:
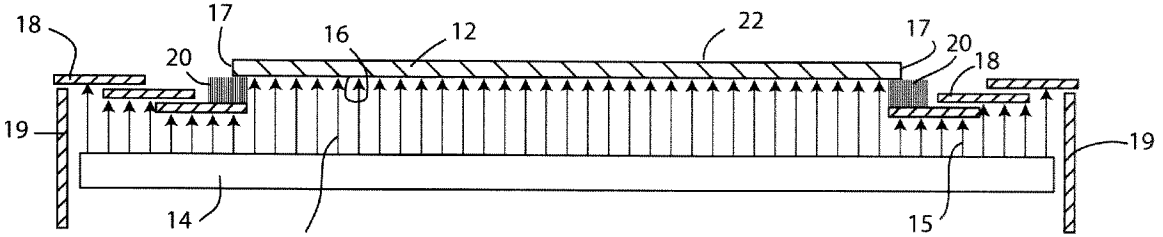
Fig. 1 (Prior Art)
FIG. 1 is a schematic vertical cross section of a prior art cooling apparatus, taken on a plane lateral to a strip being cooled, provided for purposes of comparison.

FIG. 1 illustrates a prior art apparatus of the kind mentioned earlier which will be briefly described as a basis for understanding the exemplary embodiments of the invention. The apparatus of FIG. 1 is a modification of the apparatus shown in U.S. Pat. No. 5,701,775 (the entire contents of which patent are specifically incorporated herein by this reference). The drawing shows a cross-section of a metal strip 12 advancing horizontally in a direction towards the observer at a position where the strip is to be cooled, e.g. a cooling station downstream of a rolling stand (not shown) of a single stand or multi-stand cold rolling mill. A series of horizontal transverse coolant manifolds 14, only one of which is visible in FIG. 1, are provided below the strip and are spaced from each other in the direction of strip advance. An upper side of each manifold 14 is provided with a continuous longitudinal slot that delivers jets 15 of coolant liquid (represented schematically by vertical arrows) upwardly onto a lower surface 16 of the metal strip 12. The coolant liquid is normally water, and will be referred to as such from here on for the sake of convenience, but may be any other effective liquid coolant. The jets 15 form a preferably continuous curtain of water extending under the entire width of the strip 12 and the curtain efficiently reduces the elevated temperature of the strip resulting from the rolling operation to a temperature within a desired range. However, to allow the same apparatus to be used with metal strips of different widths, the manifolds 14 extend laterally to an extent that can accommodate the widest strip likely to be rolled in the mill, and so extend beyond lateral edges 17 of the relatively narrow metal strip 12 as shown in the figure. Arrays of horizontal shutters 18 are provided along each lateral edge of the strip to block and deflect the upward travel of water jets 15 emerging from those end regions of the manifolds 14 extending beyond the lateral edges 17 of the strip. The shutters 18 are vertically stacked and may be moved sideways relative to each other to accommodate strips of different widths. Fixed vertical side plates 19 further confine the cooling water to the boundaries of the cooling apparatus. The cooling water is collected below the manifolds 14 in a sump (not shown) or the like, and may be recycled for further use. This modification of the apparatus of U.S. Pat. No. 5,701,775 has upstanding brushes 20 mounted on an upper surface of the shutters 18 closest to the edges 17 of the metal strip 12 to form a resilient screen blocking any vertical gap between inner edges of the shutters and the adjacent lateral edges 17 of the metal strip. This prevents seepage or splashing of the water onto an upper surface 22 of the strip, but with the disadvantages previously described for this kind of apparatus.

Figure 2:
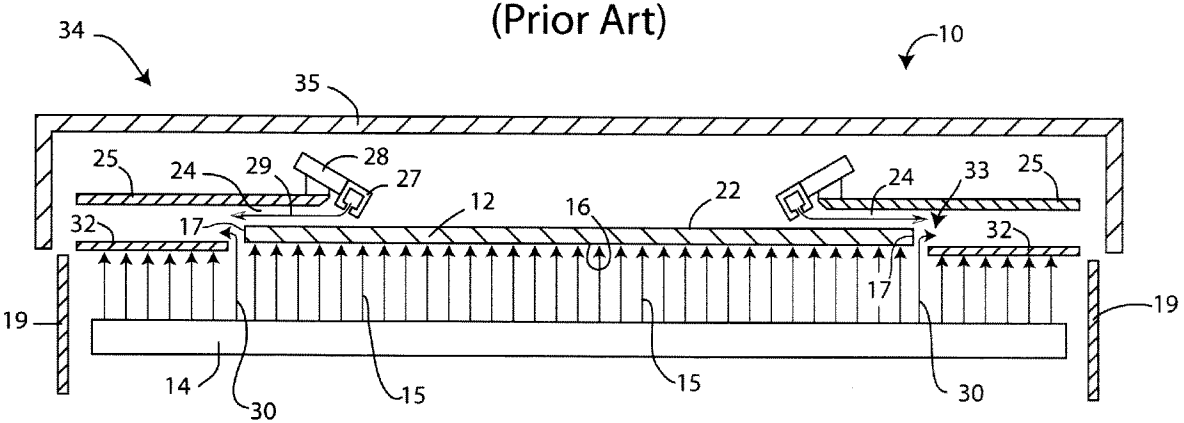
FIG. 2 is a similar schematic vertical cross section showing one exemplary embodiment of the invention.
Figure 3:
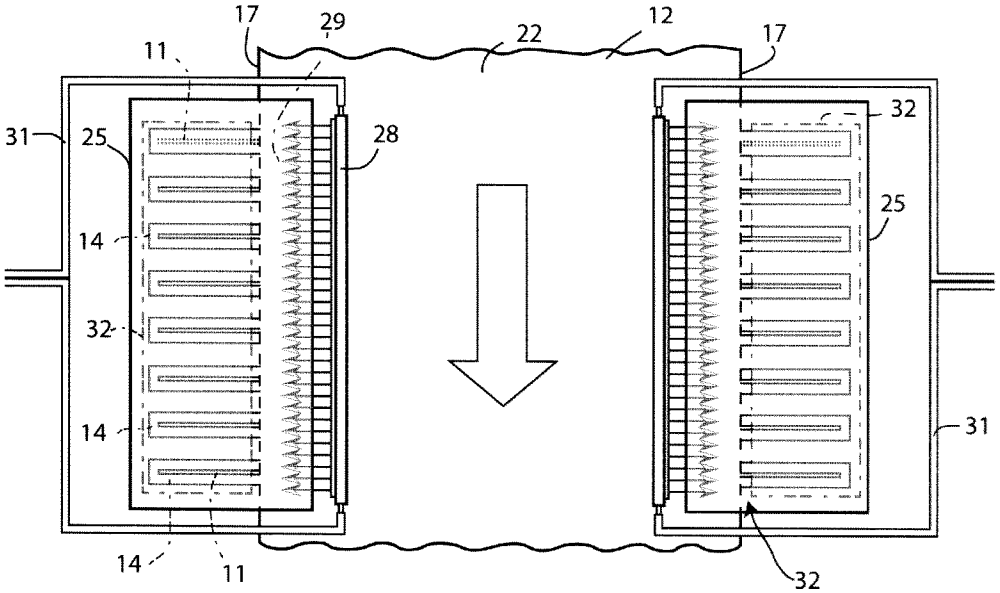
FIG. 3 is a plan view of the apparatus of FIG. 2 with the support frame removed to reveal items beneath.

FIGS. 2 and 3 are schematic diagrams showing one exemplary embodiment of the present invention. Similar or identical items to the ones illustrated in FIG. 1 are identified by the same reference numerals in these and subsequent figures. In cooling apparatus 10, a generally horizontal elongated imperforate flat cover plate 25 is provided immediately above the strip 12 along each lateral edge 17 of the strip within the extent of the cooling station 34. Each cover plate 25 creates a gas-directing channel 24 between upper surface 22 of the metal strip 12 and the immediately overlying cover plate 25. A gas, normally air but alternatively any other preferably unreactive gas, is forced into the channel 24 from an elongated nozzle 27 of an air knife device 28 (the term "air knife" is used in this description as it is the conventional term for this kind of device, but it will be recognized that the same device may deliver a gas other than air). The gas forms a moving stream of air as represented by arrows 29 extending through the channels 24 on each lateral region of the metal strip 12 in a direction from a center of the cover plate generally towards and over the lateral edges 17 of the strip. The air knives 28 on each side of the strip 12 are supplied with air under pressure via tubes 31 (see FIG. 3) leading to both ends of each air knife. In turn, the tubes are connected to a source of air under pressure, e.g. a compressor (not shown). The moving streams of air 29 are arranged to have such a speed and/or volume of flow as to deflect any water emerging from beneath the strip 12 at the lateral edges 17 thereof outwardly away from the upper surface 22 of the strip, as shown schematically by curved arrows 30 in FIG. 2. In this apparatus 10, the stacked shutters 18 of FIG. 1 have been replaced by a single sideways-movable shutter 32, but stacked shutters could alternatively be employed, if desired. In terms of vertical position, the shutter 32 is preferably no higher than the strip 12 to prevent splashing onto the surface 22 and to avoid deflection of air beneath the shutter, but it may be lower than the strip. The water jets 15 are able to extend fully up to the lateral edges 17 of the strip 12, even if the width of the strip 12 varies along its length, so that uniform cooling across the entire lower surface 16 of the strip is achieved. Any variation of the width of the strip as it is advanced can be accommodated by providing a slight gap 33 between the lateral edges 17 of the strip and the adjacent lateral edges of shutters 32. While cooling water may pass upwardly through these gaps 33 as mentioned, it is diverted away from the strip in the manner indicated. In general, the gaps 33 should be made no wider than necessary to accommodate likely variations of the width of a particular strip undergoing a cooling operation. Preferably, the shutters 32 are moved to positions where the gaps 33 are no greater than about 1 inch (2.5 cm) and no less than about 0.25 inch (0.6 cm). A more preferred range for the gap 33 is 0.25 to 0.5 inch (0.6 to 1.2 cm).

In the illustrated embodiment, the cover plates 25 preferably extend over the strip 12 for the entire length of a cooling station 34 in the direction of strip advance, i.e. completely over the longitudinal extent of all of the coolant manifolds 14, as best seen from the plan view of FIG. 3. The shutters 32 and the end parts of the cooling manifolds 14 are positioned beneath the cover plates 25, but are shown in broken lines.

The cover plates 25 should preferably be positioned at a height above the strip 12 that gives the channels 24 a depth effective to confine, channel and direct the moving air streams 29 emerging from the air knives 28 across the upper surface 22 to and across the lateral edges 17 while allowing adequate speed and volume of air flow, preferably in a laminar fashion. By creating such channels, the cover plates enhance the water-deflecting ability of the air at the lateral edges 17 of the strip by directing the air flow to these edges and preventing dissipation or the formation of eddy currents in the air. If the height over the cover plates above the strip is too great, the cover plates will have no directive or channeling effect on the streams of air and these may disperse or rise too much to produce the desired deflection of cooling water at the strip edges. On the other hand, if the height is too small, the channels 24 will be shallow and may reduce the volume and/or velocity of the air flow. In general, a height of between 0.5 inch (1.3 cm) to 1.5 (3.8 cm) inches above the upper surface 22 of the metal strip is preferred in most cases, with a most preferred height of about 1 inch (2.5 cm)±10%. As can be seen from FIG. 2, the inner (i.e. inboard or lead-in) edges of the cover plates 25 are preferably chamfered to assist and streamline the introduction of air into the channels 24.

The pressure of the air used for the air knives 28 should be sufficient to produce desirable deflection of water at the edges 17 of the metal strip. Generally, pressures from 50 to 150 psi (345 kPa to 1034 kPa) are effective, preferably generating flow rates of 40 to 50 CFM (18.9 to 23.6 liters/second), but other suitable pressures and flow rates may be used to achieve the desired effect and can be determined empirically in each case, as needed.

The cover plates 25 should preferably overlap the metal strip 12 for some distance inwardly from the edges 17 of the strip. For example, for a strip having a width of 60 inches (152 cm) the overlap may be in the range of 3 to 4 inches (7.6 cm to 10.2 cm), but the preferred overlap will generally increase as the strip width increases. At their outer sides, the cover plates 25 should preferably extend at least to the lateral edges 17, more preferably over gaps 33, and most preferably completely over the shutter 32 and beyond, but ideally short of side plates 19. At their inner sides the cover plates 25 can extend close to the middle of the strip but this would lead to the air knives being at a maximum distance from the strip edges 17, resulting in a less effective flow of air 29. It is also possible to have a single cover plate 25 extending across the entire width of the strip to and beyond both lateral edges 17, in which case the air knives 28 may be positioned in the gap between the cover plate 25 and the strip 12.

The air knives 28 are preferably positioned no more than about 1 inch (2.5 cm) inwardly of the cover plates 25 in the direction towards the center of the metal strip 12, and the nozzles 27 of the air knives are preferably oriented toward the lateral edges 17 at an angle between the horizontal and vertical, preferably to provide an impingement angle of the air with the strip of between 30 to 45°. The air knives 28 may also be made an integral part of the cover plates 25.

Figure 4:
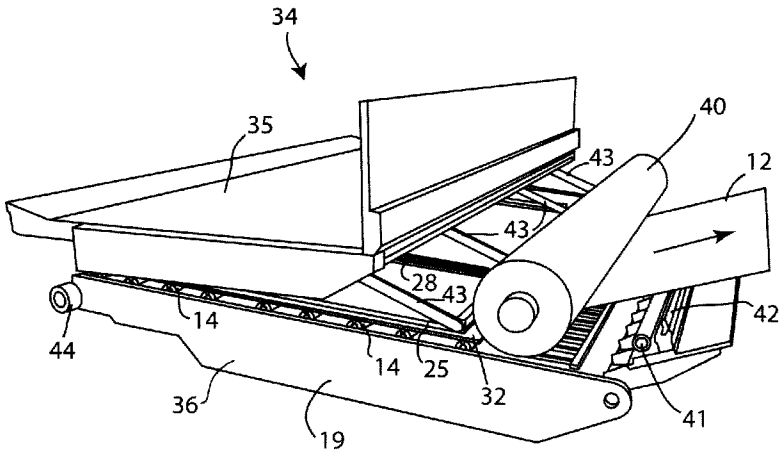
FIG. 4 is a perspective view of apparatus of the kind shown in FIGS. 2 and 3 with additional equipment.

FIG. 4 is a perspective view of apparatus at a cooling station 34 showing the embodiment of FIGS. 2 and 3 with additional equipment, including a cooling table 36, which supports the cooling manifolds 14 and the sheet 12 as it advances through the cooling station. The cooling table is hinged about a transverse pivot 44 so that it too can be lowered or raised for easy access during service or repair. In the illustrated embodiment, the cover plates 25 are suspended from an inside surface of the support frame 35, in the form of a box-like cover, which covers most of the upper surface 22 of the metal strip 12 as the strip advances through the cooling station. The support frame 35 can be raised or pivoted upwardly from its operating position to facilitate service or repair, and this in turn raises the supported cover plates 25 and air knives 28 to allow unrestricted access to the metal strip 12 and the cooling equipment. The path of the strip 12 through the cooling station 34 is kept generally horizontal by a hold-down roller 40, following which the strip 12 is deflected slightly upwardly, as shown. Although not visible in this view, a coolant liquid removal device is provided across the lower surface of the strip beneath the hold-down roller 40. This device is preferably a liquid knife, e.g. as disclosed in U.S. Pat. No. 5,701,775, or a squeegee type wiper strip. The device completely removes any coolant liquid from the lower surface of the strip. Oil may then be applied to the lower surface 16 of the strip from an applicator 41 and excess is removed by a wiper 42.

Figure 5:
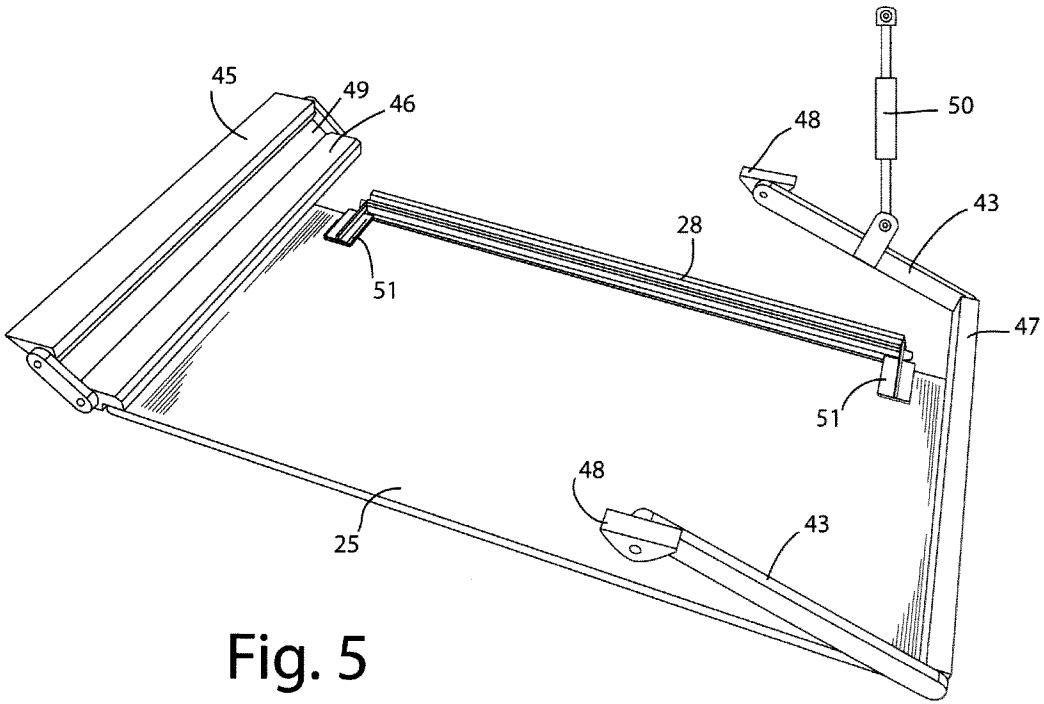
FIG. 5 is a perspective view of equipment forming part of the apparatus of FIG. 4.

The manner in which the cover plates 25 are suspended from the support frame 35 is shown more clearly in FIG. 5 from which support frame 35 itself has been omitted for greater clarity. Each cover plate 25 is firmly secured to an entrance mounting bar 46 and an exit mounting bar 47. The exit mounting bar 47 is pivotally attached at its ends to elongated links 43, and the entrance mounting bar is pivotally attached to a hinge bar 49. Links 43 are, in turn, pivotally attached to pivot plates 48 fixed to an inner surface of the support frame 35 (not shown in FIG. 5). The hinge bar 49 is also pivotally attached to an inner surface of the support frame 35 via a pivot bar 48. The vertical height of the cover plate 25 relative to the support frame 35 is determined by an adjustment mechanism comprising a turnbuckle assembly 50 (or other device, e.g. a hydraulic piston/cylinder arrangement) that is itself fixed to the support frame 35. The links 43 and hinge bar 49 allow the cover plate to be kept generally horizontal as its height is adjusted by operation of turnbuckle assembly 50. The arrangement also allows the cover plate to be raised almost completely to the inner surface of the support frame 35 for stowing. As mentioned earlier, the air knife 28 is suspended from the inboard side of the cover plate 25 by end brackets 51, so it moves in tandem with the cover plate 25. The hinge bar 49 and the pivot bar 45 are preferably made from mill duty steel and are capable of absorbing the impact of an inadvertent strip break to protect the more sensitive downstream members, e.g. the air knife 28.

Figure 6:
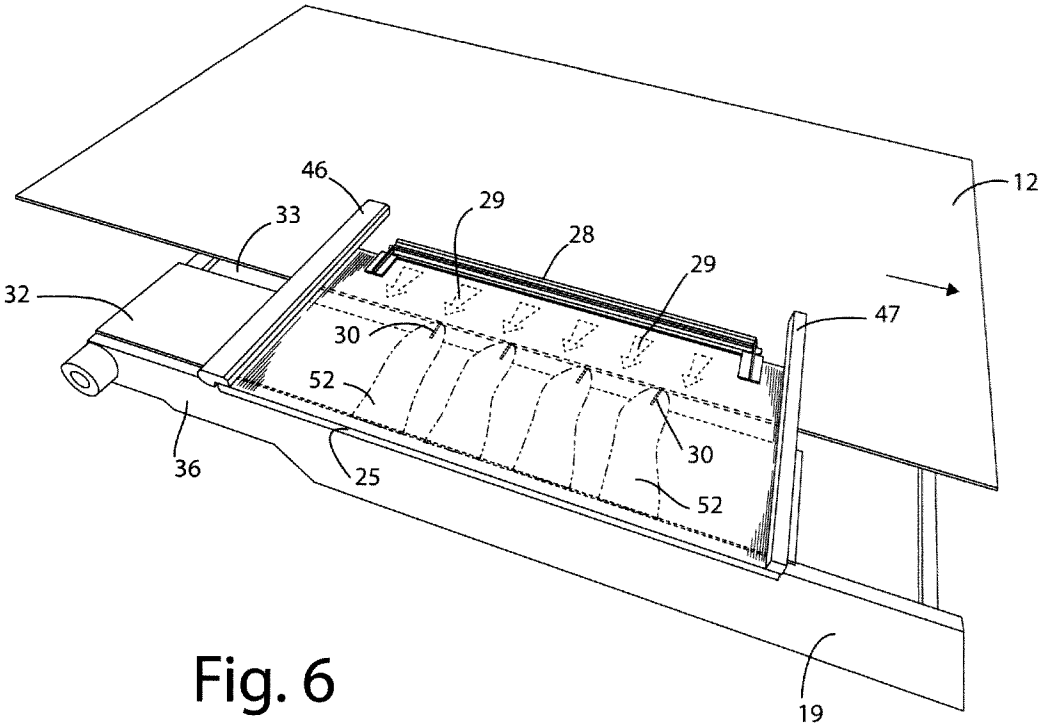
FIG. 6 is a partial perspective view of the apparatus of FIG. 4 showing the apparatus in operation.

FIG. 6 is a schematic partial view of the apparatus of FIG. 4 illustrating the flow of air and cooling water at one side only of the strip 12. The cover plate 25 overlies part of the strip 12 adjacent to the lateral edge 17 and the shutter 32. These elements are shown in broken lines where they are obscured by the cover plate 25. A gap 33 exists between the strip 12 and the shutter 32 and jets of water 30 emerge through the gap from manifolds (not shown) below the strip and shutter. An air stream 29 from air knife 28 is shown by arrows and extends between the strip 12 and the cover plate 25. When the air stream encounters the jets 30, the cooling water is diverted away from the strip 12 as outwardly-directed plumes 52 (proceeding along the underside of the cover plate and/or the upper side of the shutter) generally having the shapes shown in the drawing (shapes based on an embodiment having a strip of 60 inches in width, a cover plate overlapping the strip by 3 to 4 inches, a gap of 0.75 inch between the strip and the cover plate, a shutter extending 0.25 to 1 inch outboard from the strip edge and an air knife of 30 inches in length positioned 1 inch inboard of the cover plate, having an impingement angle of 30 to 45° and fed with air under a pressure of about 80 psi to produce an air flow of 40 to 50 cfm). The cooling water from these plumes eventually pours into a gap between the shutter 32 and vertical side plates 19 of the cooling table 36.

Figure 7:
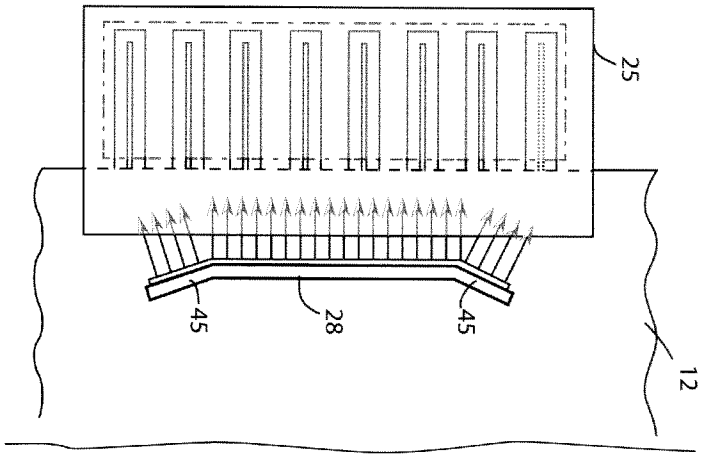
FIG. 7 is a view similar to part of FIG. 3, but showing an alternative design of an air knife.

While it is desirable to extend the air knives completely across a series of manifolds 14 to ensure that the air stream 29 directly contacts each of the water jets 30 emerging through the gap 33, it will be appreciated from FIG. 4 that there is often restricted room available beneath the support frame 35 because of the presence of various other components of the apparatus. It may therefore not be possible in some cases to provide air knives that extend fully over all of the manifolds 14 in the direction of strip advance, particularly the first and last manifolds of a series of such manifolds. In such cases, as shown in the partial view of FIG. 7, it is desirable to angle the air knives 28 at their ends 45 to cause the air streams from the ends to extend towards upstream and downstream regions of the cover plate and thereby towards the manifolds that are not directly covered by the knives. This helps to prevent any water leakage onto the upper surface of the strip from the end manifolds. Although single air knives with angled ends are shown in FIG. 7, each knife may be replaced by three separate shorter air knives with the central knife being parallel to the strip edge 17 and the two end knives oriented in the same manner as the ends 45 of the single knife shown in FIG. 5, i.e. towards upstream and downstream regions of the cover plate. As a further alternative, a straight air knife may be provided with internal ribs (not shown) that create an outwardly angled flow from each end of the knife. As a still further alternative, the air knives may be provided with numerous swiveling nozzles along the length of the knives instead of a single elongated slot. The nozzles may then be oriented individually to provide the most effective air flow beneath the cover plates. In such cases, it may be desirable not just to angle the end nozzles towards upstream and downstream regions of the cover plate, as in the case of the air knives described above, but also to angle the central nozzles, e.g. to direct more air to positions directly overlying a coolant manifold than to zones between such manifolds.

As noted, this angled orientation of the air streams is desirable in particular when the air knives do not cover (overlie) all of the coolant manifolds 14. However, an angled orientation of this kind may still be desirable when the air knives are long enough to cover all manifolds. This is because the moving streams of air beneath the cover plate 25 may in some cases have a tendency to converge as they move towards the outer edges of the cover plates, thus producing relatively stagnant zones at the inlet and outlet sides of the cover plates. Therefore, an outwardly angled orientation directs more air towards these potential stagnant zones and prevents their formation.

Where possible, it may also be desirable to provide air knives that are longer than their respective cover plates so that the air knives project beyond the cover plates at the entrance and exit locations thereof. This also helps to ensure that the moving air streams beneath the cover plates do not have stagnant zones at the entrance and exit ends.

All of the above embodiments employ shutters 32 to minimize the amount of coolant water that jets above the level of the metal strip 12. While such shutters 32 are desirable in most cases, they may be entirely omitted when the streams of air 29 are strong enough to ensure that all of the water jets from the ends of the manifolds are deflected away from the upper surface of the strip. Furthermore, while the cover plate 25 has been shown as extending beyond the outer (outboard) edge of the shutter, in some cases it does not need to extend so far and indeed, need not extend even to the edge 17 of the strip 12 provided that the stream 29 of air emerging from the channel 24 is of sufficient force to suitably deflect the emerging jets of water and that the distance from the strip edge does not lead to undue dissipation of the air stream. If no shutter is provided, it is preferable that the cover plate extend at least to the outer (outboard) end of the jets of water emerging from the manifolds to provide some control of the extent of the water spray within the apparatus. Still further, while the above embodiments have provided cover plates 25 along both sides of the strip 12, embodiments having just a single cover plate arranged at one side of the strip may be desirable in some cases. Each side of a strip has its own functionality, although it is normally desirable to cool both edges in the same way. Still further, it may in some cases be desirable to provide a single cover plate extending completely over the metal strip from adjacent one lateral edge to the other. Air knives may be mounted beneath such a strip, or extend through it, to produce the desired air streams toward the strip edges. A single air knife having outlets directed in opposite directions may be effective in such cases.

While the embodiments of the invention described above are intended for use within a single-stage or multi-stage cold rolling mill, such embodiments may alternatively be used wherever a moving strip article is to be subjected to liquid cooling on one side while avoiding contact of the opposite side with the coolant liquid. As mentioned in the introduction of this specification, this may include (but is not limited to) the cooling of coated metal sheet following the application and heat-curing of a layer of coating lacquer, the cooling of hot-rolled aluminum strip before it is coiled at the end of a hot rolling line, the cooling of metal sheet during a stand-alone coil-to-coil operation or thermally conditioning the strip by pre-cooling prior to further rolling or surface pretreatment operations.

Other embodiments and variations of the invention will be apparent to persons skilled in the art after reviewing the above description. All such embodiments and variations form part of this invention to the extent that they are included within the following claims.

What is claimed is:

1. A method of cooling a metal strip, the method comprising:

continuously advancing the metal strip, having lateral edges, generally horizontally in a direction of strip advance and below a cover plate, wherein the cover plate is spaced from the strip;

delivering a coolant liquid onto a lower surface of the metal strip from below across an entire width of the strip;

forming a gas-directing channel immediately above the upper surface of the metal strip adjacent to at least one of the lateral edges wherein the gas-directing channel is formed at least in part by the upper surface and at least in part by the cover plate; and forcing a gas through the channel in a direction generally parallel to the strip and generally away from a center of the strip towards the at least one of the lateral edges to deflect coolant liquid away from the upper surface.

2. The method of claim 1, wherein said cover plate is positioned to extend laterally of the strip at least up to said at least one lateral edge of the strip.

3. The method of claim 1, wherein said cover plate is positioned to extend laterally of the strip beyond said at least one lateral edge of the strip.

4. The method of claim 1, wherein coolant liquid is delivered upwardly from at least one manifold extending transversely below said strip and extending laterally beyond said at least one lateral edge thereof.

5. The method of claim 4, wherein at least some of said coolant liquid delivered from ends of said at least one manifold extending outwardly beyond said at least one lateral edge of the strip is deflected downwardly by at least one stationary shutter provided alongside said strip.

6. The method of claim 5, wherein said at least one stationary shutter is arranged with a lateral spacing from said at least one lateral edge of the strip to provide a gap wide enough to accommodate variations of thickness of said strip as it is advanced relative to said at least one shutter.

7. The method of claim 1, wherein the gas is forced through the gas-directing channel by delivery of the gas under pressure from at least one elongated air knife positioned at an end of said channel inwardly of the strip.

8. The method of claim 7, wherein the air knife is angled to deliver the gas under pressure at an angle within a range of 30 to 45° relative to said upper surface.

9. The method of claim 1, wherein said gas is forced through said channel at an initial pressure in a range of 50 to 150 pounds per square inch.

10. The method of claim 1, wherein said gas is forced through said channel at a flow rate in a range of 40 to 50 cubic feet per minute.

11. The method of claim 1, wherein said gas-directing channel is elongated in said direction of strip advance and has upstream and downstream sides, and wherein said gas is directed generally at right angles to said at least one lateral edge of the strip in a center of said channel between said upstream and downstream sides, but at slight upstream and downstream angles to said lateral edge of the strip at said upstream and downstream sides, respectively, of said channel.

12. The method of claim 1, wherein said gas-directing channel is formed above both said lateral edges of the strip.

13. Apparatus for cooling an elongated metal strip having lateral edges, as the strip is advanced generally horizontally in a direction of strip advance, the apparatus comprising:

coolant delivery equipment for directing a coolant liquid upwardly onto a lower surface of the advancing strip across an entire width of the strip between said lateral edges thereof;

a cover plate positioned above and spaced upwardly from an upper surface of the advancing strip, wherein the cover place and the upper surface of the advancing strip form a gas-directing channel immediately above the upper surface of the advancing strip adjacent to at least one of the lateral edges; and a gas delivery device positioned at an inward end of said gas-directing channel to deliver gas through the channel generally parallel to the strip and generally towards said at least one lateral edge.

14. The apparatus of claim 13, wherein said cover plate extends laterally of the strip at least up to said at least one lateral edge of the strip.

15. The apparatus of claim 13, wherein said cover plate extends laterally of the strip beyond said at least one lateral edge of the strip.

16. The apparatus of claim 13, wherein said coolant delivery equipment comprises at least one coolant liquid manifold provided with at least one opening positioned to deliver said coolant liquid and oriented transversely of the strip.

17. The apparatus of claim 13, wherein said coolant delivery equipment comprises two or more coolant liquid manifolds each provided with at least one opening positioned to deliver said coolant liquid and oriented transversely of the strip.

18. The apparatus of claim 17, wherein said cover plate extends above all of said two or more coolant liquid manifolds in said direction of strip advance.

19. The apparatus of claim 17, wherein said cover plate extends above some, but not all, of said two or more coolant liquid manifolds in said direction of strip advance.

20. The apparatus of claim 13, wherein said coolant delivery equipment delivers coolant liquid upwardly beyond said at least one lateral edge of said strip.

21. The apparatus of claim 20, including a shutter at said at least one lateral edge of the strip positioned to deflect downwardly some of said liquid coolant delivered beyond said at least one lateral edge, said shutter being positioned at a distance from said at least one lateral edge to form a gap to accommodate variations of width of said strip as the strip advances.

22. The apparatus of claim 13, wherein said gas delivery device is at least one air knife.

23. The apparatus of claim 22, wherein said at least one air knife is oriented to deliver said gas at an angle in a range of 30 to 45° relative to said upper surface of the strip.

24. The apparatus of claim 22, wherein said at least one air knife has a single elongated slot through which said gas passes.

25. The apparatus of claim 22, wherein said at least one air knife has multiple gas outlets provided with direction-adjustable nozzles.

26. The apparatus of claim 22, wherein said at least one air knife has a central region, an upstream region and a downstream region, and wherein said central region is oriented to direct said gas generally at right angles to said at least one lateral edge of the strip, the upstream region is oriented to direct said gas towards said at least one lateral edge at an upstream angle, and said downstream region is oriented to direct said gas towards said at least one lateral edge at a downstream angle.

27. The apparatus of claim 13, wherein said cover plate is suspended from a support frame positioned above said advancing metal strip.

28. The apparatus of claim 27, wherein said cover plate includes pivoted supports that allow said cover plate to be raised and lowered relative to said support frame.

29. The apparatus of claim 13, wherein said cover plate is spaced upwardly from said strip by a distance in a range of 0.5 to 1.5 inches.

30. The apparatus of claim 13, wherein said cover plate is spaced upwardly from said strip by a distance of 1 inch±10%.

31. Apparatus for cold rolling a metal strip having lateral edges, said apparatus comprising: at least one roll stand for reducing a thickness of said metal strip, and an apparatus for cooling said metal strip immediately downstream of said at least one roll stand, wherein said apparatus for cooling the metal strip comprises an apparatus according to claim 13.

32. The method of claim 1, further comprising removing said coolant liquid from said lower surface of the strip.

33. The apparatus of claim 13, further comprising a removal device for subsequently removing the coolant liquid from said lower surface of the strip.

* * * * *